US006457536B1

(12) United States Patent
Bye et al.

(10) Patent No.: US 6,457,536 B1
(45) Date of Patent: Oct. 1, 2002

(54) METHOD AND SYSTEM FOR EXPLOITING NATURAL RESOURCES UNDER THE SEABED

(75) Inventors: Morten Bye, Moss; Leiv Wanvik, Nesøya; Terje Karp, Vøyenenga, all of (NO)

(73) Assignee: Kvaerner Oil & Gas A.S., Lysaker (NO)

( * ) Notice: Subject to any disclaimer, the term of this patent is extended or adjusted under 35 U.S.C. 154(b) by 102 days.

(21) Appl. No.: 09/641,520

(22) Filed: Aug. 21, 2000

(30) Foreign Application Priority Data

Sep. 15, 1999 (NO) ..... 994464

(51) Int. Cl.[7] ..... E21B 7/128; E21B 43/01
(52) U.S. Cl. ..... 175/7; 166/354; 166/358
(58) Field of Search ..... 175/7; 166/358, 166/354

(56) References Cited

U.S. PATENT DOCUMENTS

| | | | | |
|---|---|---|---|---|
| 3,315,741 A | * | 4/1967 | Triplett | 166/352 |
| 3,605,668 A | * | 9/1971 | Morgan | 114/293 |
| 4,436,048 A | * | 3/1984 | Gentry et al. | 114/230.12 |
| 4,892,495 A | * | 1/1990 | Svensen | 114/230.12 |
| 5,957,074 A | | 9/1999 | de Baan et al. | |
| 6,314,901 B1 | * | 11/2001 | Smedal | 114/230.12 |

FOREIGN PATENT DOCUMENTS

| | | | |
|---|---|---|---|
| FR | 2768118 | | 3/1999 |
| NO | 174377 | | 4/1994 |
| NO | 964582 | | 10/1996 |
| NO | 974639 | | 10/1997 |
| WO | WO 9626861 | | 9/1996 |
| WO | 99/44883 | * | 9/1999 |

* cited by examiner

*Primary Examiner*—Hoang Dang
(74) *Attorney, Agent, or Firm*—Young & Thompson

(57) ABSTRACT

A surface vessel is anchored almost geostationarily by a turret rotatable relative to the vessel about a vertical axis and having mooring cables extending to the seabed. A well is drilled from a drilling section in the vessel at a distance from the axis of rotation of the turret. The drilling is performed using a drill string through a riser extending from the seabed to the drilling section, which riser can be broken and shut off between the seabed and the vessel. By manipulating (hauling in and slackening) the mooring cables, the vessel is held in position so that the derrick is kept almost geostationary relative to the well during drilling operations. The system includes a surface vessel, a turret rotatable relative to the vessel about a vertical axis and which can be anchored to the seabed by a plurality of mooring cables, and a riser extending from the seabed to the vessel through which the well can be drilled with a drill string from a derrick in a drilling section on board the vessel. The turret and the drilling section are arranged so as to be spaced apart in the longitudinal direction of the vessel. The riser is arranged in a circular sector around the turret which is free of mooring cables and possible production risers. The turret includes elements for manipulating (hauling in/slackening) the mooring cables. The riser is capable of breaking and being shut off between the seabed and the vessel.

10 Claims, 11 Drawing Sheets

METHOD AND SYSTEM FOR EXPLOITING NATURAL RESOURCES UNDER THE SEABED

FIELD OF THE INVENTION

The invention relates to the exploitation of natural resources under the seabed, primarily the recovery of hydrocarbons (oil and gas) from formations under the seabed.

More specifically, the invention relates to a method for exploiting natural resources under the seabed, where a surface vessel is anchored almost geostationarily with the aid of a turret that is rotatable relative to the vessel about a vertical axis and has mooring cables extending to the seabed, and where drilling and/or production of a well in the seabed is carried out from the vessel.

The invention also relates to a system for drilling a well in a seabed, comprising a surface vessel, means for holding the vessel in a desired position above a point on the seabed, which means comprise a turret that is rotatable relative to the vessel about a vertical axis and which can be anchored to the seabed by means of a plurality of mooring cables, and a riser extending from the seabed to the vessel through which the well can be drilled using a drill string from a derrick in a drilling section on board the vessel.

BACKGROUND OF THE INVENTION

Hydrocarbon recovery from floating structures (floaters) is well known today. Such floaters may be in the form of a ship or in the form of semi-submersible units. The first known floaters were barges which were anchored using a plurality of anchors in the seabed and from where drilling operations were carried out. As the move was made into deeper water, equipment was developed which made it possible to drill despite the motions of the vessel.

In areas of the world where climatic conditions are rather harsh it is in practice virtually impossible for a vessel to lie having a particular directional orientation because wind and current, at times straight from the side, produce forces which far exceed the capacity of the mooring, not to mention the problems which are due to the rolling of the vessel.

In view of this, attempts have been made to introduce turret-based mooring on drill ships so as to enable the ship to turn with the weather and wave direction. At the same time, drill ships were introduced that have so-called dynamic positioning (ships with no mooring which maintain their position with the aid of gauges, automatic controls and propellers) and where a turret was superfluous to need, and these have since been the dominant solution whenever traditional fixed anchoring was not acceptable.

However, turret-based mooring had its renaissance in the form of what is known as production ships (FPSO: floating production, storage and offtake). Like drill ships, these vessels are provided with a turret in order to obtain a weathercock effect. As the ships grew to a considerable size, 100,000 tonnes dead weight and more, it became desirable to place a drilling system on board. This was particularly the case at great ocean depths where separate drilling vessels gave rise to substantial costs, and was also due to the fact that a large FPSO can easily be designed to take aboard additional weight and provide additional space for a drilling system. The size of these ships means that in terms of motion they can be compared with today's semi-submersible drilling rigs, especially if the drilling system were placed in the midship region.

Several methods and systems have been proposed for such arrangements. Common to all is that it is desirable to pass the drill string down from or through the geostationary turret. Obviously, the reason for this is that in doing so the same freedom is obtained to operate with full weathercock effect, even when drilling operations are underway.

Inevitably, a solution of this kind will be rather complex, as there will be a rather large accumulation of functions on a small, concentrated area by the turret: the actual turret with bearing and braking/turning mechanism, anchor winches, production risers with valves and transfer equipment, drill floor with derrick-well opening and safety valve handling, tension machines for the drilling risers and so forth.

In order to avoid this, a vessel has been proposed that has no turret but has pure dynamic positioning and flexible production risers which are suspended in the vessel in such manner that they do not come into conflict with the drilling area and drilling risers, which it is desirable to maintain geostationary relative to the seabed. The drawback of this design is that the ship can only achieve a weathercock effect of 80–90° to either side of the nominal direction. This can be remedied to some extent by the ship having two bows and being able to turn 180° in order to continue the weathercock motion, with the stem against the wind. In regions where the climate is harsh, there will, of course, be a huge fuel consumption in order to hold the ship in position, and also a not inconsiderable safety problem if difficulties in holding position arise. Solutions without a turret and based on a system with a plurality of taut mooring cables taken into the midship region have also been proposed. With the aid of fast, controlled winch operations, the vessel can to a certain extent follow the direction of the wind. It has been proposed that this variant should be equipped with a double bow (a bow at each end). When the vessel has turned on its moorings to an extreme point the need arises for a rapidly executed change in direction of 180°. Common to all double bow solutions is that there is a problem as regards the location of living quarters, escape routes, the location of flares and the natural ventilation of the drilling and process plant. A rapid 180° turn-around operation in rough seas is not particularly attractive either.

One of the objects of the present invention is to provide an improved solution as regards the said unfavourable conditions.

The known turret solutions, with drilling and production through the turret, are not completely satisfactory, especially as regards space and safety considerations. A great improvement can be achieved by separating the drilling area on the vessel from the turret, which permits the use of a traditional swivel solution in order to bring the produced gas/liquid on board, and also makes it possible to use a drilling area shaped like a traditional drill ship (normally dynamically positioned).

Of course, a drilling area placed outside the turret gives rise to some new problem areas.

Drilling in deep water takes place through a riser extending from the wellhead on the seabed to the vessel. If drilling has to be stopped because of the weather conditions (normally because of excessive heaving), the first step will be to hang the drill pipe up inside the safety valve on the seabed. The next step will be to pull the drill string up or break it off in the safety valve, whilst the riser remains connected throughout. This situation can prevail until the next operation barrier, where there is a risk that the heaving of the vessel may exceed that which can be compensated in the so-called telescopic joint uppermost in the riser arrangement. Before this happens, the connection with the seabed must be broken. Traditionally, the riser is then broken on the top of the safety valve on the seabed in a suitable pipe connection, the so-called connector. The procedure that follows is that the riser is hauled up to run clear of the equipment on the seabed by means of the tension machines on the vessel. In this condition, with the full length of the riser hanging below the vessel, the vessel can then ride out the storm and re-tie the connection once the weather has improved.

In the stormy conditions described, a dynamically positioned vessel will have no difficulties as regards the weathercock turning of the ship since the riser hangs freely and will follow the movement of the vessel. A turret-moored vessel with a corresponding riser arrangement will only be capable of operating in such stormy conditions (with riser hanging below the vessel) if the drilling and riser arrangement is placed in and operated through an opening in the actual turret. The obvious reason is that the drilling arrangement in another position on the vessel will rapidly result in the riser being able to impinge on the mooring cables and possible production risers, both of which are geostationary, whilst the vessel and the drilling riser turn with the weather. A theoretical possibility is to pull up the entire length of the riser and thus run clear of the said obstructions. In the offshore industry this would be considered extremely inexpedient as such an operation can take up to four days at great ocean depths (1500–2000 m) and result in completely unacceptable efficiency (or lack thereof) and considerable risk.

Recently, there have been proposals for a riser which is capable of breaking relatively close to the vessel and is made having a buoyancy means and a blow out preventer valve at the point where the riser breaks. Use of such a riser facilitates a relatively rapid disconnection because the length of piping which must be pulled up is greatly reduced.

SUMMARY OF THE INVENTION

A particular object of the present invention, especially in areas (waters) where there are stable weather conditions, in particular sustained, dominant wind directions, is to facilitate drilling and production in deep water (e.g., 100 meters or more) in a risk-reduced manner using existing technology, with the drilling centre as an at least almost geostationary point.

According to the invention there is therefore proposed a method as mentioned above, characterised in

- that the drilling of the well is carried out from a drilling section in the vessel at a distance from the axis of rotation of the turret;
- that the drilling is carried out using a drill string through a riser extending from the seabed to the drilling section, which riser can be broken and shut off between the seabed and the vessel; and
- that the vessel upon manipulation (hauling in and slackening) of the mooring cables is held in position so that the drilling centre is kept almost geostationary relative to the well during drilling operations.

According to the invention there is also proposed a system as mentioned above, characterised in that the rotating unit and the drilling section are arranged so as to be

- spaced apart in the longitudinal direction of the vessel;
- that the riser is arranged in a circular sector around the turret which is free of mooring cables and possible production risers;
- that the turret consists of means for manipulating (hauling in/slackening) the mooring cables; and
- that the riser is capable of breaking and being shut off between the seabed and the vessel.

Further features of the new method and system according to the invention are disclosed hereinafter.

Further features of the new method and system according to the invention are disclosed in the dependent method and apparatus claims respectively.

BRIEF DESCRIPTION OF THE DRAWINGS

The invention will now be explained in more detail with reference to the drawings, wherein.

DETAILED DESCRIPTION OF THE INVENTION

Figure 1:
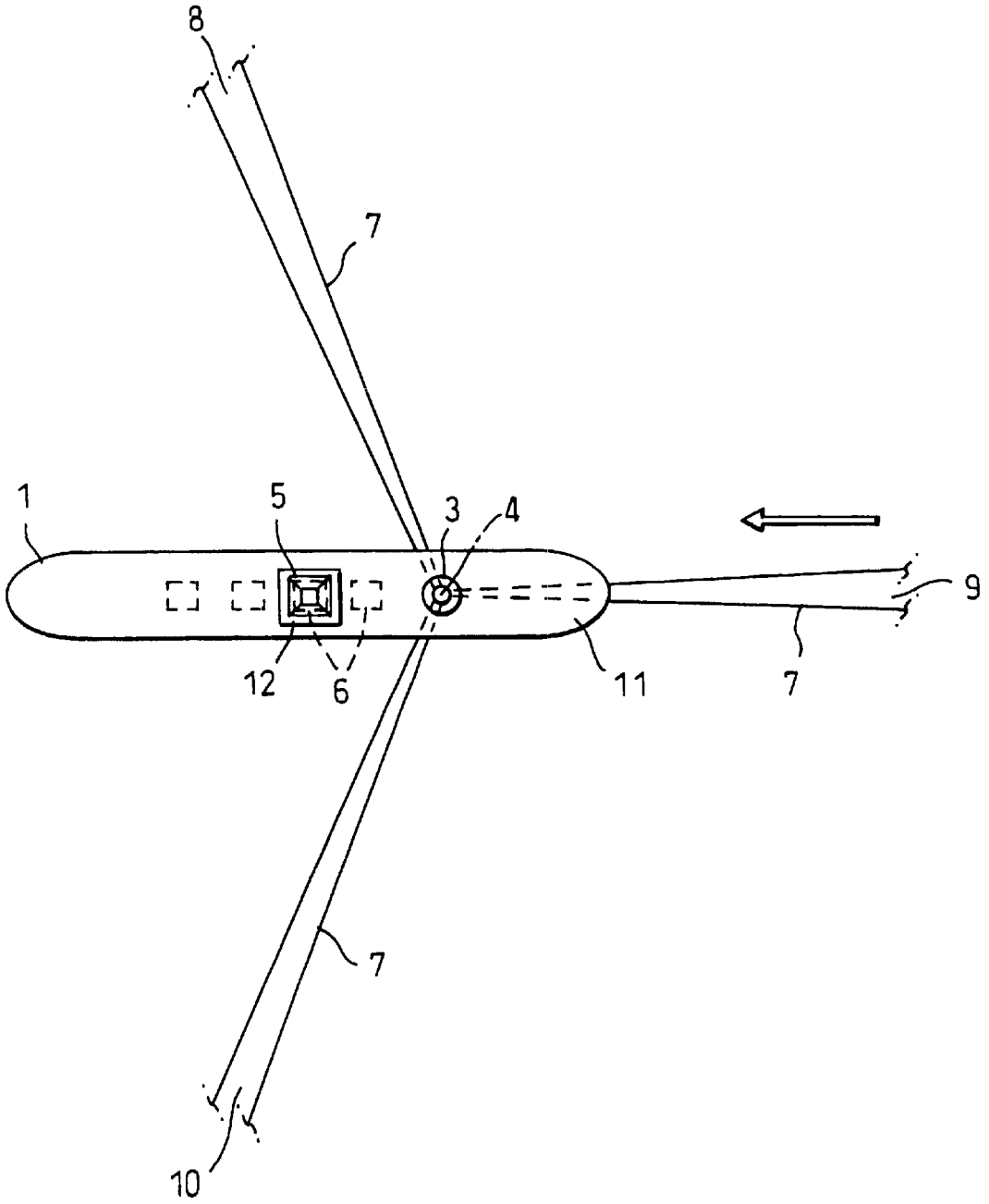
FIG. 1 shows in a purely schematic manner an anchored surface vessel according to the invention.

The same reference numerals are used in each figure to designate the same or similar components.

Figure 2:
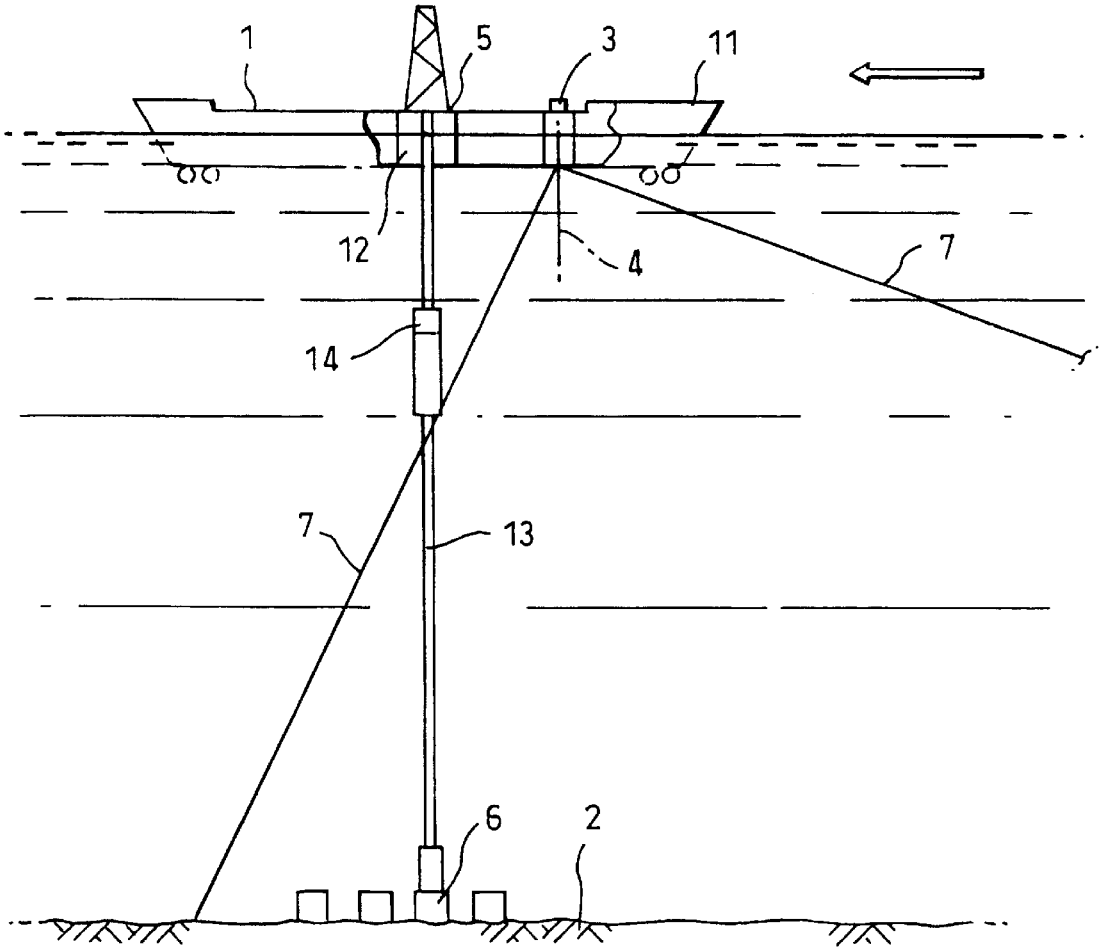
FIG. 2 is a schematic side view of the vessel in FIG. 1.

FIG. 1 shows a surface vessel 1 for exploiting natural resources under the seabed 2, see FIG. 2, which vessel 1 has a turret 3 anchored to the seabed 2 and which is rotatably supported in the vessel 1 about a vertical axis 4. In this figure this vertical axis 4 has been placed in the front half of the vessel.

A drilling arrangement including a derrick/well opening 5 is placed astern of the axis 4, preferably close to the midship region, for drilling a well 6 in the seabed 2.

The turret 3 is anchored by means of mooring cables 7, which in the exemplary embodiment are arranged in a cluster pattern, in this case in three clusters 8, 9 and 10 spaced apart at an angle of 120°. Other angles, for example, also asymmetrically spaced angles, are possible. Each individual mooring cable 7 runs in a known manner from a winch (not shown) or the like on the turret 3 down through the turret into the sea to a non-illustrated anchor on the seabed 2. This mooring technique is well known per se to and therefore is not described in more detail here. What is novel is a particular positioning of the turret 3 and the laying of the mooring cables 7 in a sector which basically is located forward of the derrick 5 and towards the end of the vessel 11 closest to the turret 3 when the vessel has an optimum orientation as in FIG. 1.

The drilling section, including derrick 5 of the vessel 1, is astern of the vertical axis 4. The vessel 1 has in a known manner a vertical well 12 in the drilling section, and the derrick 5 is placed in a known way over this well 12. Drilling is carried out (FIG. 2) through a riser 13 capable of breaking and being shut off, and which can be broken and shut off at 14 in a known way per se.

The prevailing wind direction is indicated by means of an arrow in FIGS. 1 and 2.

Figure 3:
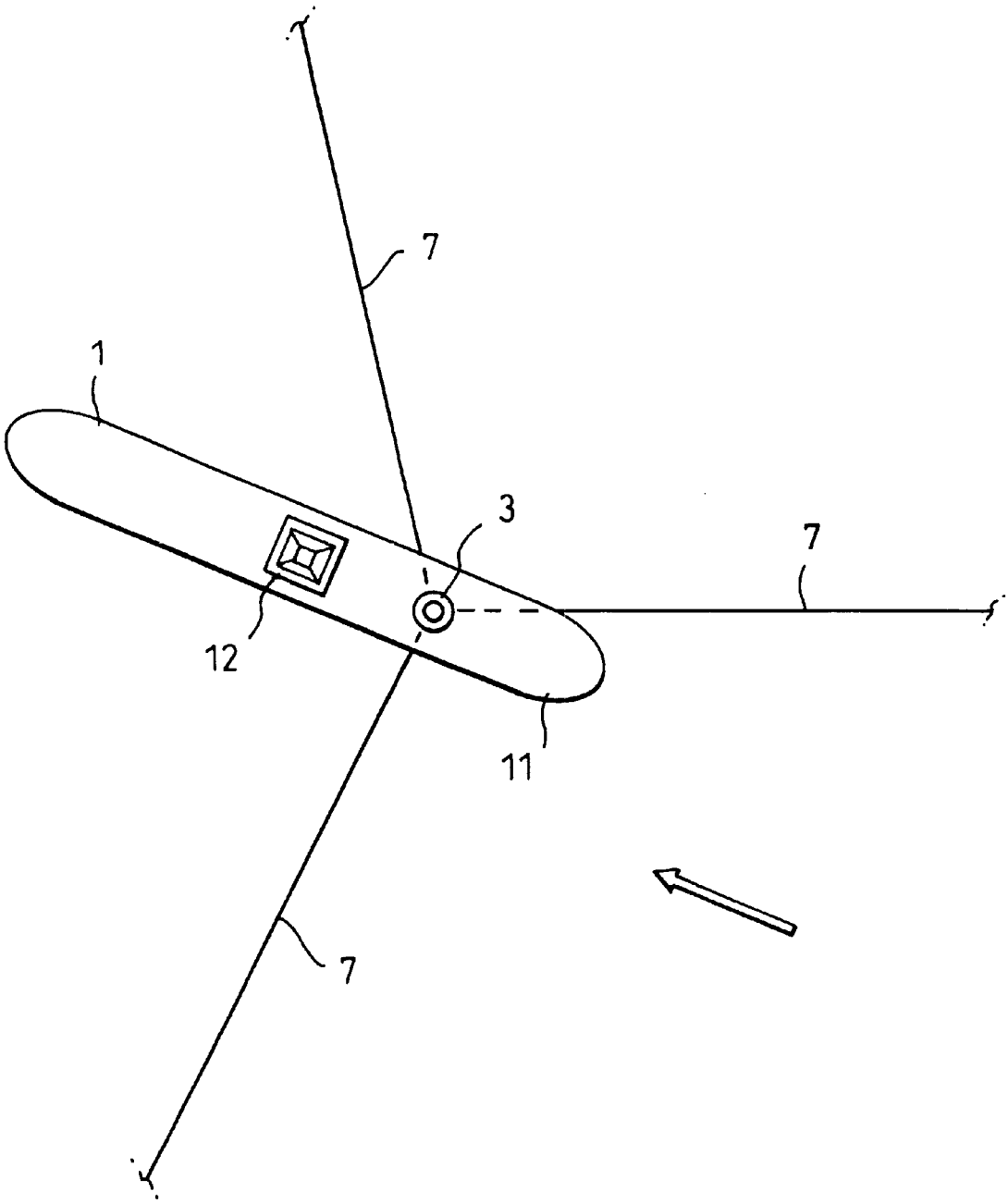
FIG. 3 shows the vessel shown in FIG. 1 in a second position of rotation.

In FIG. 3 the wind direction (the arrow) has changed slightly, and the vessel 1 has turned accordingly, whilst the position of the derrick 5 is maintained relative to the well 6 that is being drilled.

The vessel 1 has made a turn in the desired direction about an axis which runs through the drilling centre and the well on the seabed, i.e., an axis through the riser connection 13. To render this possible, the turret 3 has made a translatory change of position. The turret 3 has followed an at least almost circular path having a radius about the drilling centre. Such a change in position has been rendered possible by manipulating the mooring cable 7 with the aid of the non-illustrated winches on the rotating unit 3.

This procedure can be repeated each time it is necessary to turn the vessel again. The riser connection 13 will at all times be intact and drilling operations can be carried out on a continuous basis.

Figure 4:
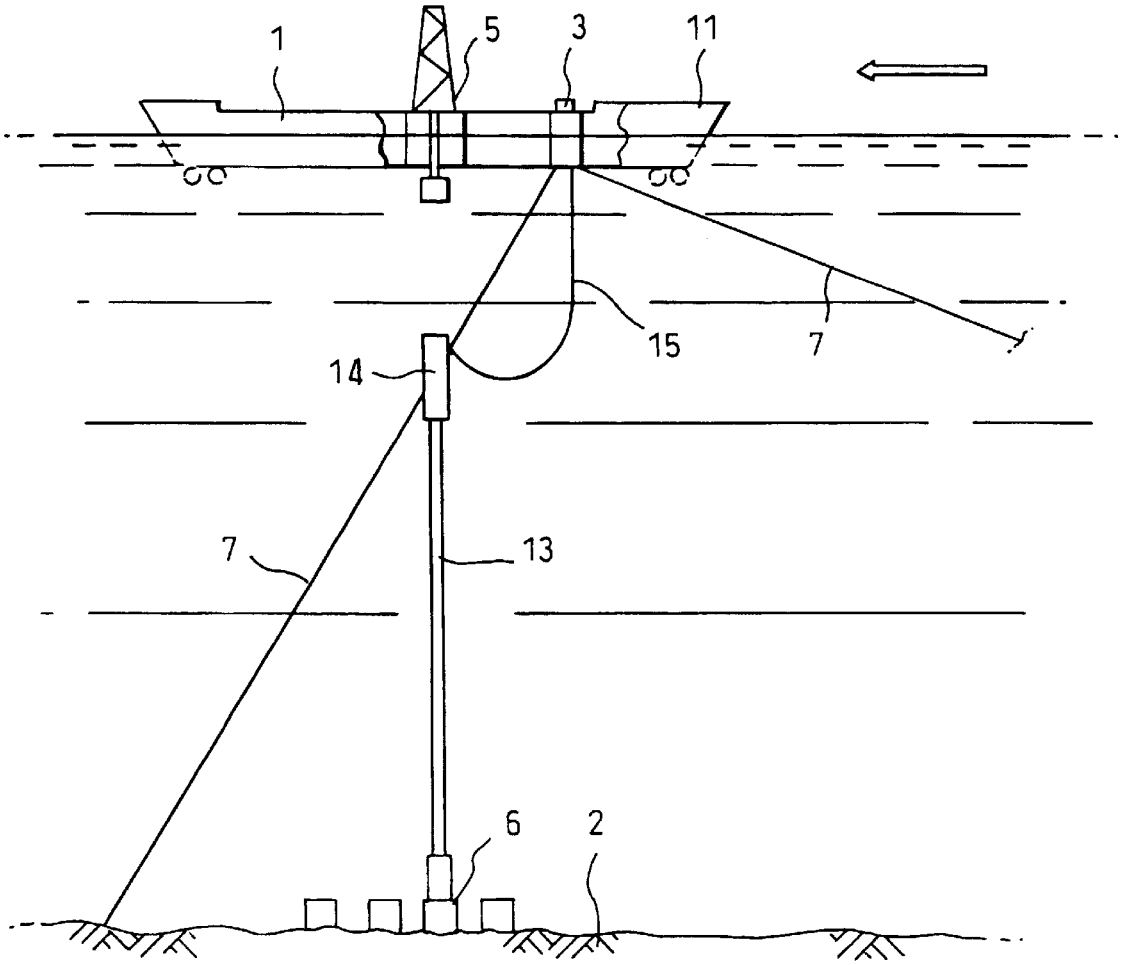
FIG. 4 is a side view of the vessel as in FIG. 2, with a broken and shut-off riser connection.

At a certain time the mooring cables 7 may impinge on the riser 13 (normally somewhere between 45–90°, depending upon the design of the arrangement). In order to facilitate, if necessary, a further turning of the vessel 1, unimpeded by the mooring cables 7, the connection 14 can be broken and the upper part of the riser can be pulled up, as shown in FIG. 4. Now the vessel 1 wilt be able to turn further without being impeded by the closest mooring cables 7. A buoyancy body and a blow out preventer valve (not shown in detail) are provided at the connection 14.

Although the connection in the riser 13 has now been broken and shut off, contact is maintained with the riser 13 by means of a plurality of connecting lines 15 which connect the upper pressure safety valve/buoyancy body with openings and points of attachment in the vessel's 1 turret 3.

Here, it is conceivable that several functions are provided for, such as the safety valve-control connection, the "kill and choke" line connection which makes it possible to circulate the well, optionally circulation of the drilling mud which is inside the riser, the compressed air in order to control buoyancy tanks, so-called "booster" lines to prevent the drilling mud from settling and hardening in the riser, and so forth.

In one embodiment, it is also conceivable to allow production risers to be secured to the drilling riser 13 so that risers of metallic materials/composite materials can be used instead of flexible hoses, straight from the seabed to the turret (standard embodiment). The connection 15 can be maintained intact even if the vessel 1 turns n×360° when the risers end up in the turret 3.

In addition to drilling, the vessel can also be used for production of hydrocarbons. This is shown schematically in FIGS. 5 and 6.

Figure 5:
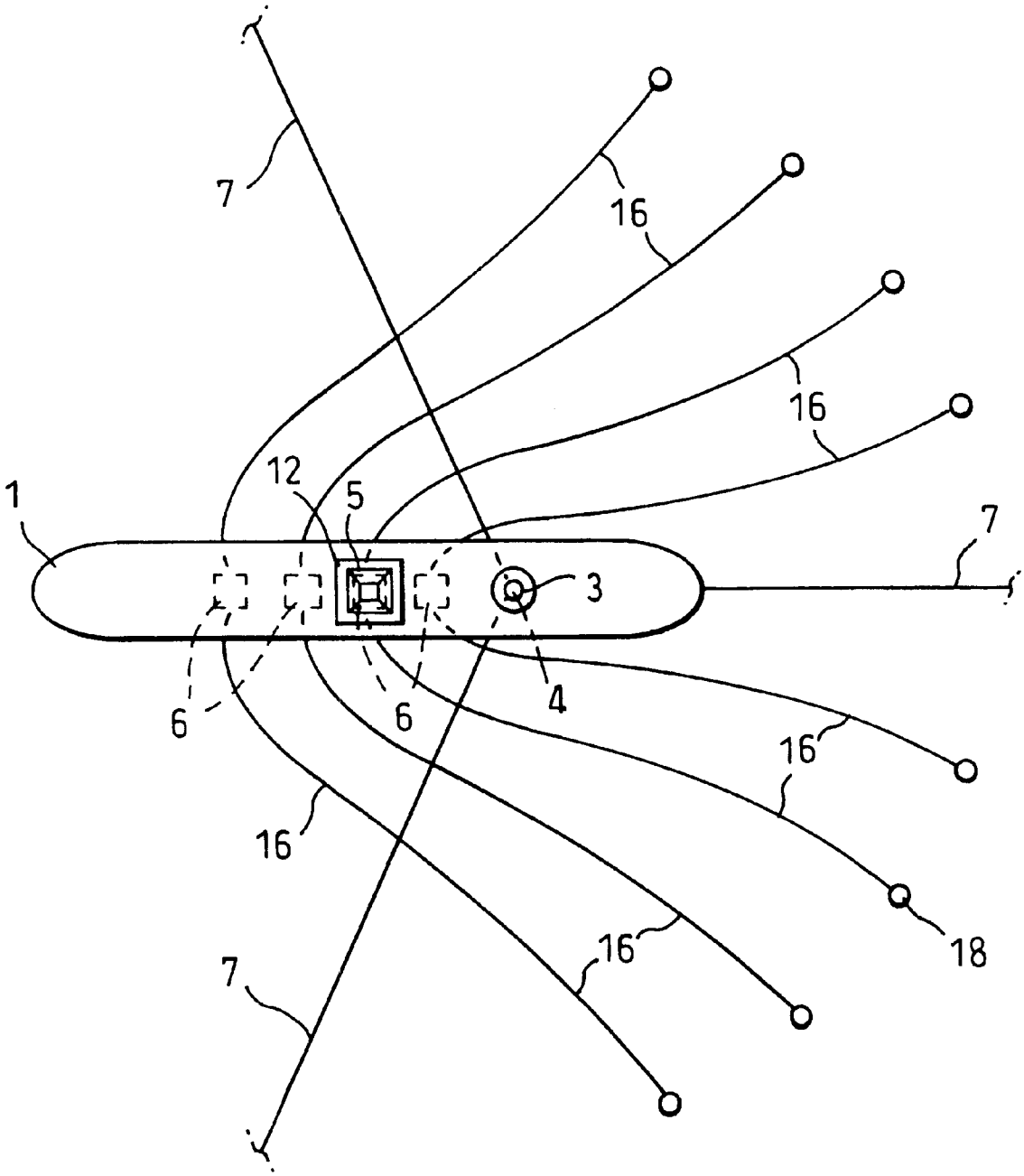
FIG. 5 shows the anchored vessel above a possible well arrangement with production risers.
Figure 6:
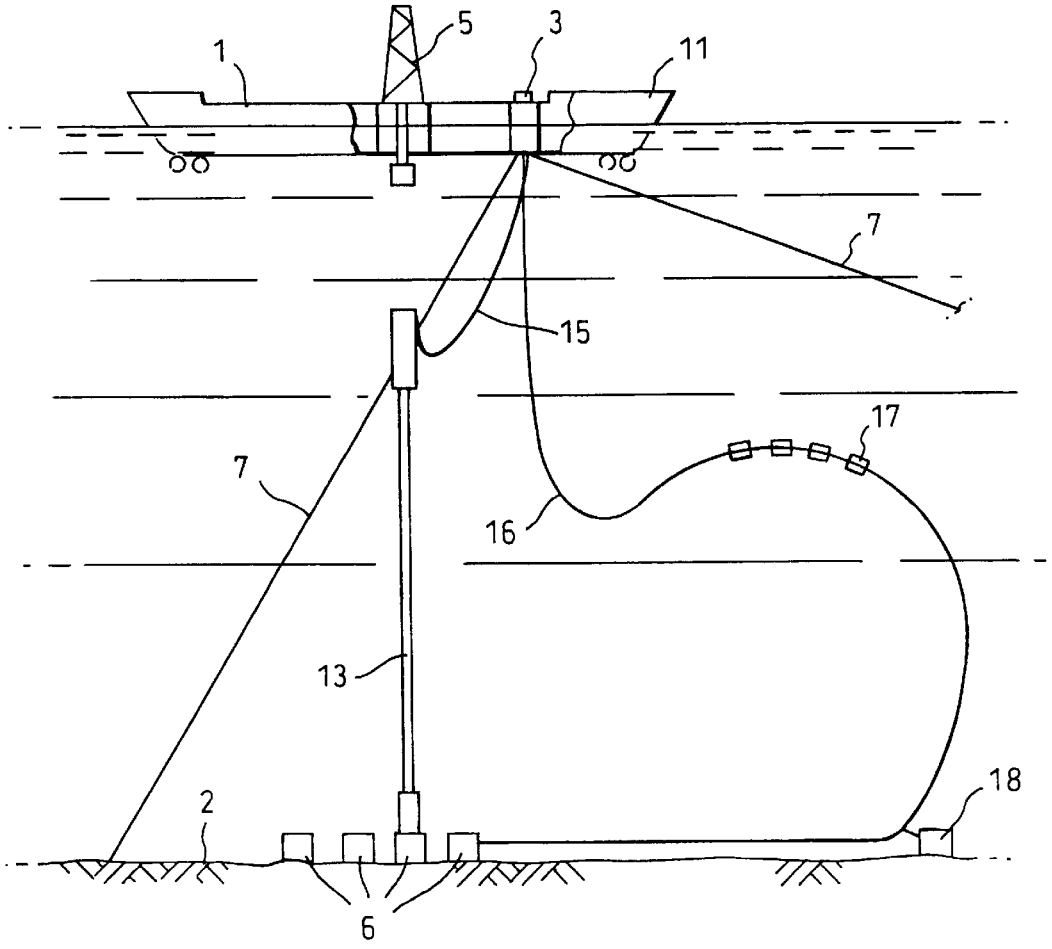
FIG. 6 is a schematic side view of the vessel in FIG. 5.

In FIGS. 5 and 6 the vessel is shown in position above a plurality of wells 6 which produce through the flexible risers 16. These risers 16 are in a known way led up through the water, see in particular FIG. 6, and are, according to the invention, led into the sector area where the mooring cables 7 are to be found. These flexible risers are led up in a known manner with support from floats 17, see FIG. 6, and with anchor blocks 18.

By slackening and hauling in the mooring cables 7, the vessel 1 can at any given time be positioned so that the drilling centre can be held reasonably geostationary, or so that the vessel 1 remains in a desired position relative to the production risers 16.

It is not shown, but the production risers 16, instead of being as shown in FIG. 6, can be gathered in towers which extend up from the seabed, in the free sector section between the mooring cables 7/cable clusters 8, 9, 10.

The capacity of the vessel 1 to turn through an angle with unbroken riser connection 13 will be dependent upon the mooring pattern, the distance between the turret 3 and the drilling centre 5, 13 and the diameter of the turret 3, and any possible devices on the turret.

Taking a cluster pattern spread at an angle of 120° (as shown in FIG. 1) as a starting point, it is possible to increase the angle capacity by backing the vessel into the drilling sector, thereby opening up the angle so that it becomes larger, e.g., 150°. This method will be quite effective in shallower waters as the angles of the moorings change quickly when the vessel is moved. Another way is to increase the distance between the turret and the drilling centre. An advantage will then be gained in that the angle of clearance between the riser and mooring will be smaller for the same physical distance (measured from riser to closest mooring cable).

By using a combination of these methods, critical angles of 50° to about 70° can be obtained before the disconnection of the riser 13 is required.

A third method, based on a large turret diameter effect means that it is possible to obtain an angle of rotation capacity of almost 90°.

This is made possible by using a respective articulated rigid arm 19 on the two mooring cable clusters 8 and 10 which potentially may impinge on the riser 13.

These arms 19 are used to lead the mooring cables 7 in the clusters 8, 10 from a point on the periphery of the turret 3 (radius 5 meters or the like) to a point which has a larger radius, for instance, 12 meters.

Figure 7:
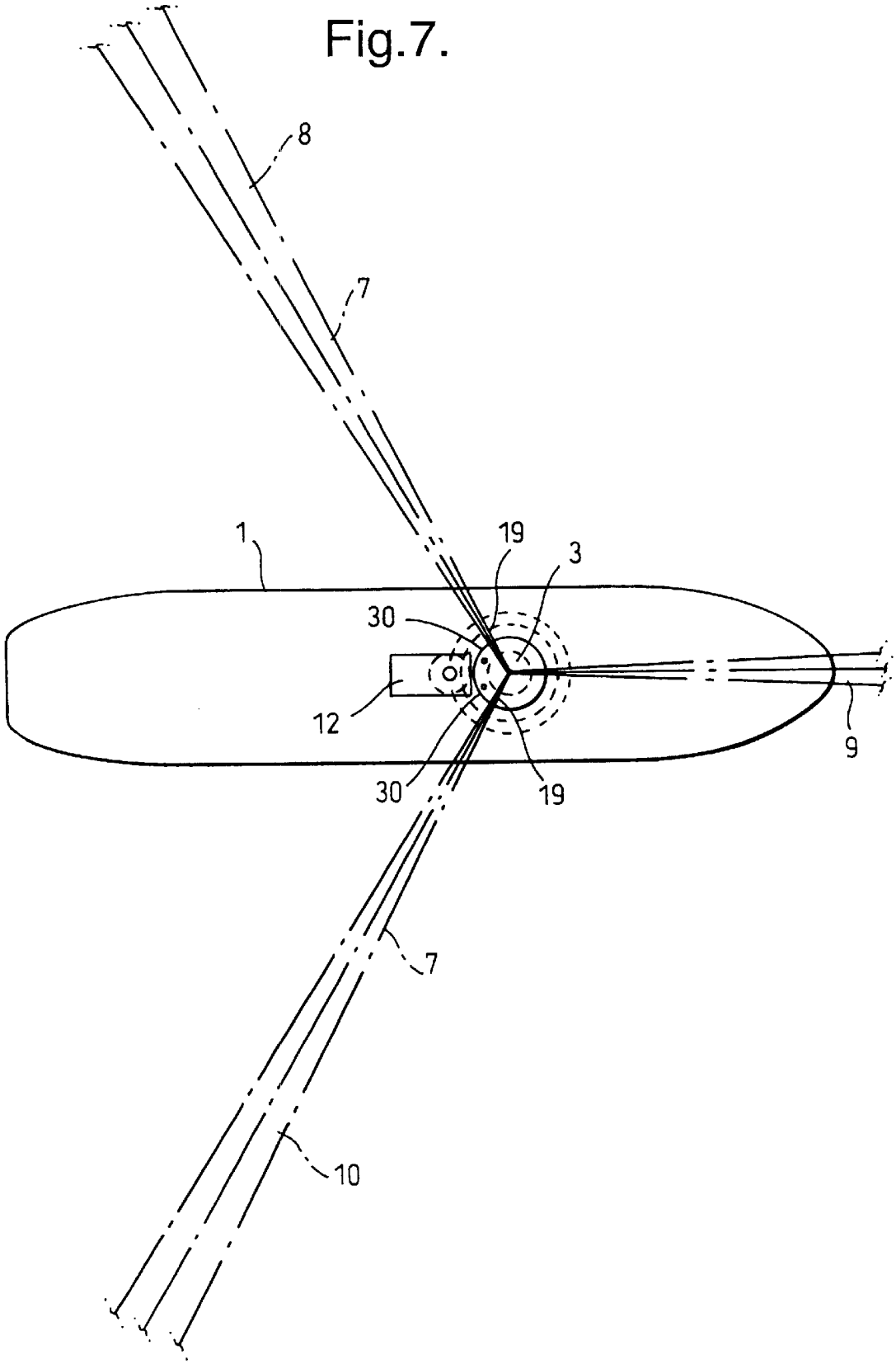
FIG. 7 is a schematic view of an anchored, modified surface vessel according to the invention.
Figure 8:
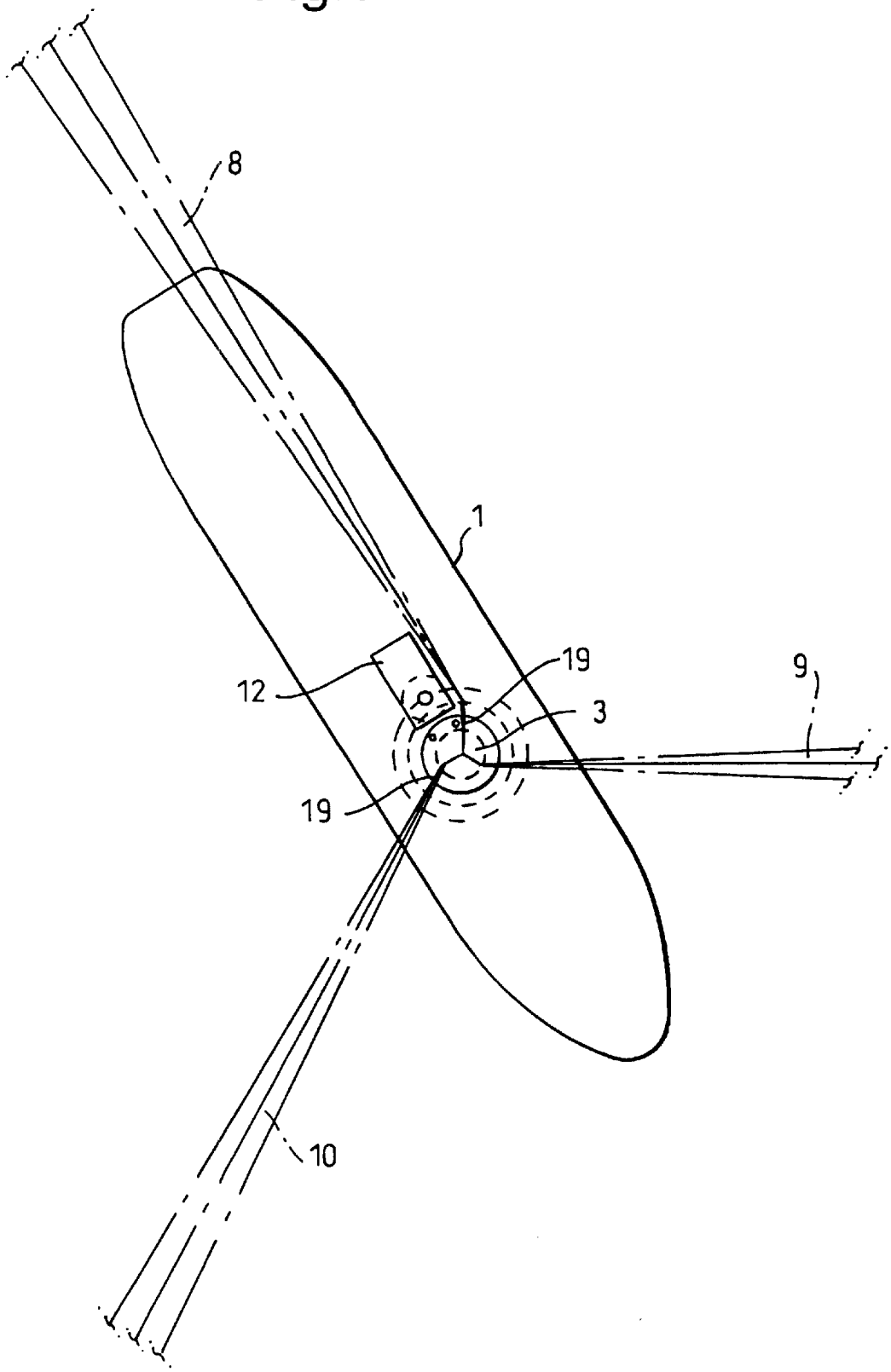
FIG. 8 shows the vessel in FIG. 7 in a second position of rotation.
Figure 9:
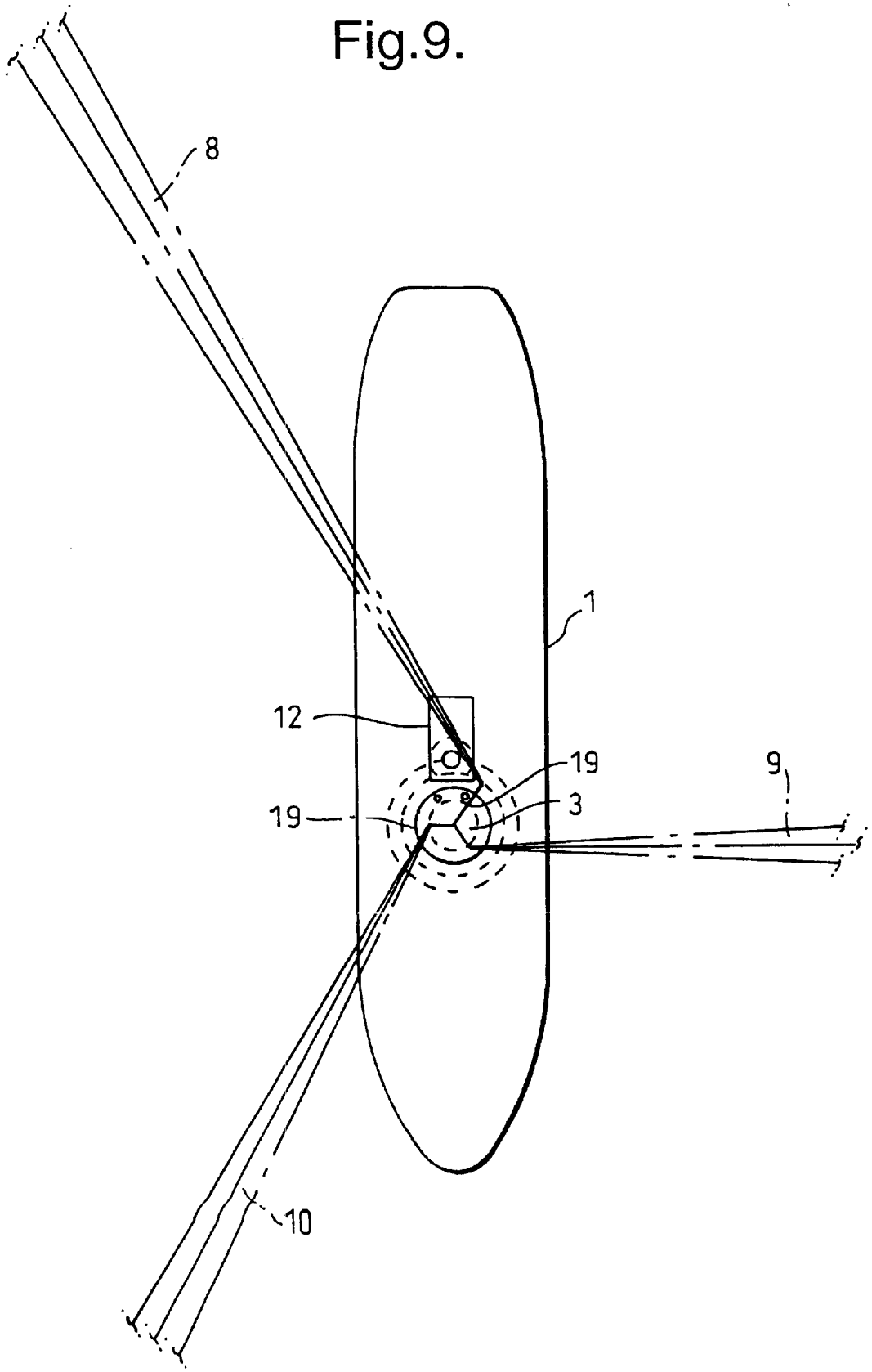
FIG. 9 shows another position of rotation of the vessel in FIGS. 7 and 8.
Figure 10:
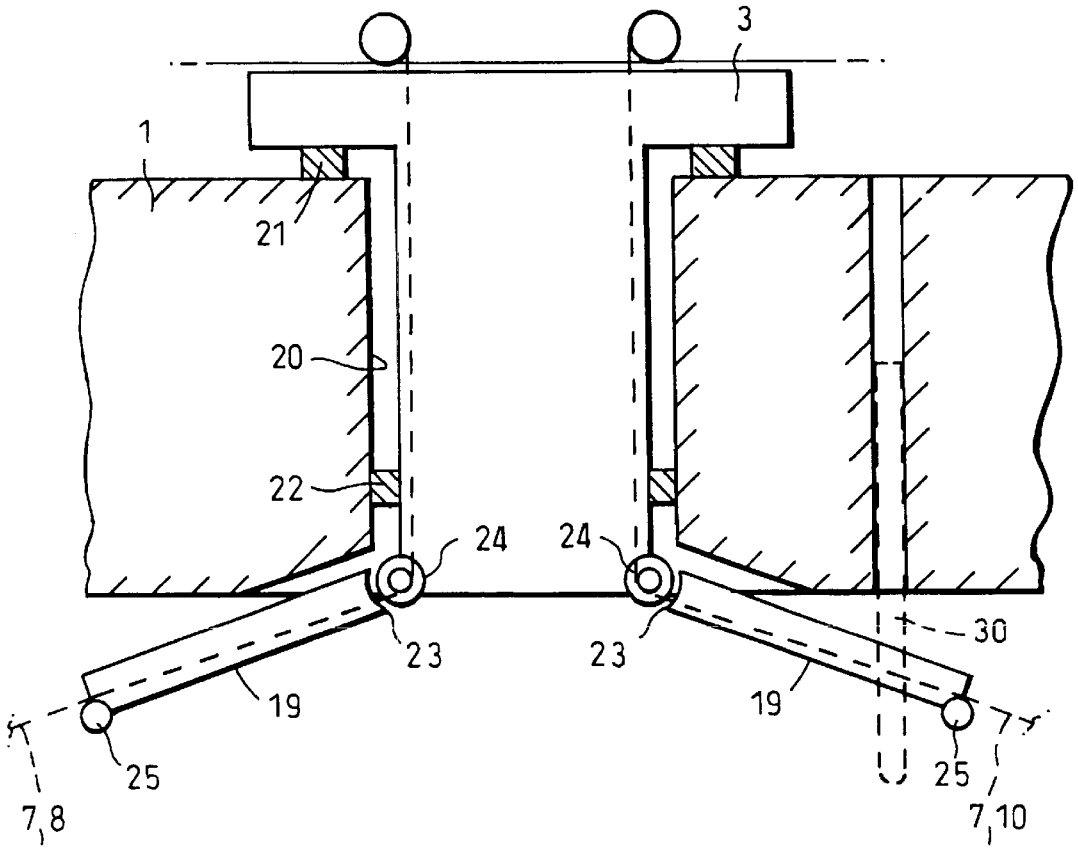
FIG. 10 shows a schematic section of a surface vessel equipped with a turret having an arm arrangement according to the invention.
Figure 11:
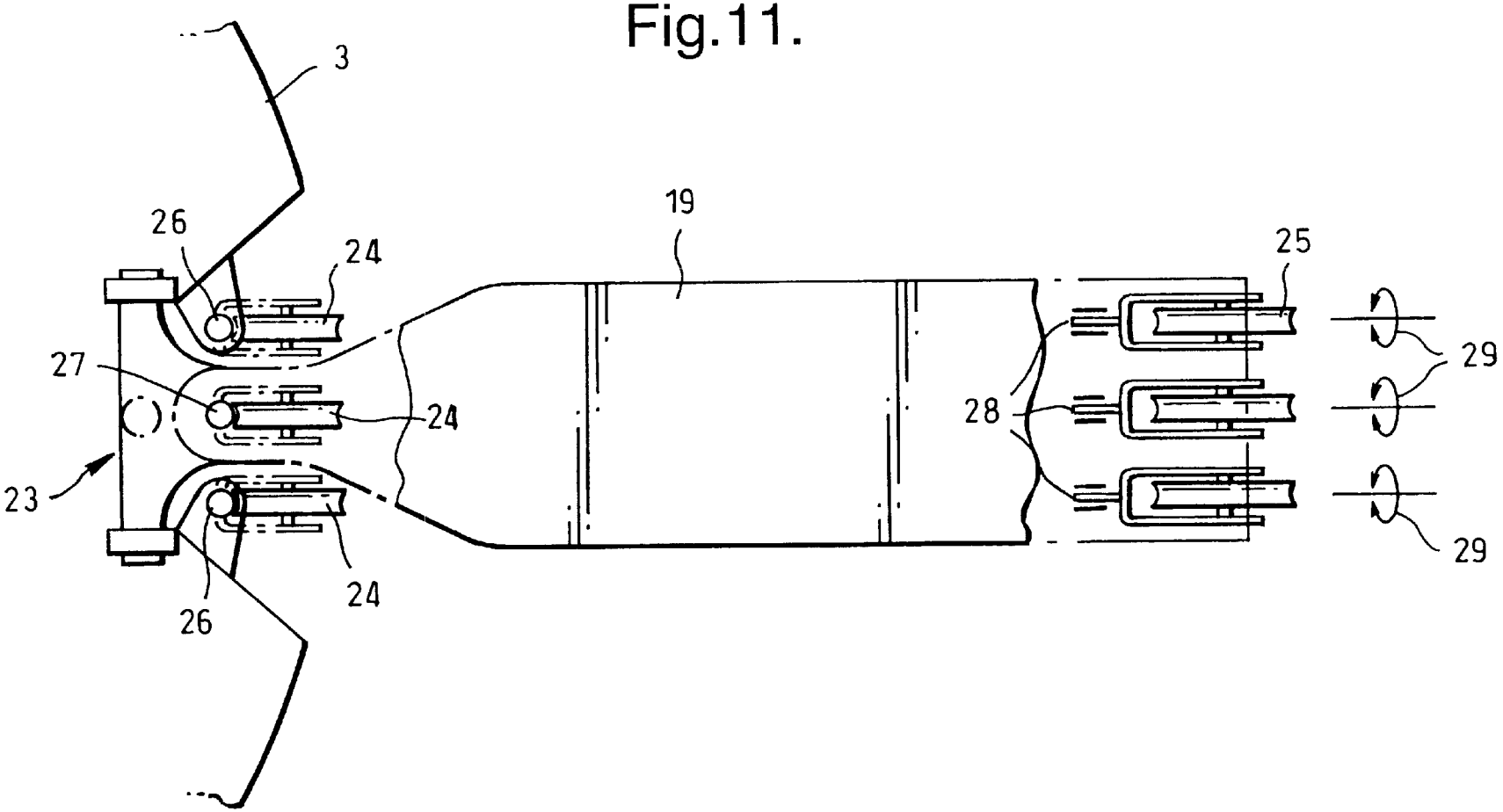
FIG. 11 shows on somewhat larger scale and purely schematically a horizontal section of an arm in the turret-arm arrangement in FIG. 10.

In addition to being illustrated in FIGS. 7, 8 and 9, a possible arm arrangement is also shown in more detail in FIGS. 10 and 11.

FIG. 10 shows a schematic section through the vessel 1 in the turret area. The turret is passed into a vertical well 20 in the hull of the vessel 1 and is supported in a known way by means of bearing 21, 22. For each cable cluster 8, 10, which in the exemplary embodiment both consist of three mooring cables 7, an arm 19 is swivel-supported at the bottom of the rotating unit 3. As shown in particular in FIG. 11, each arm 19 is supported in the rotating unit 3 with the aid of a Cardan's suspension 23, and the arm 19 has three inner guide discs 24 and three outer guide discs or guide pulleys 25.

The two outermost inner guide discs 24 are pivotally supported at 26, so that the discs as such can pivot in the horizontal plane (the paper plane in FIG. 11), whilst the middle guide disc 24 is pivotally supported at 27 on the arm 19.

The three outer guide discs are pivotally supported on the arm 19 as shown in FIG. 11, so that the discs 25 thus can turn about horizontal axes 28, as indicated by the arrows 29.

The mooring cables are passed as shown in FIG. 10, i.e., under the guide discs 24 and over the outer guide discs 25 and onwards in the direction of the seabed. There are provided non-illustrated guides for the respective cable 7 in each arm 19.

It is known art per se to suspend arms of this kind using a Cardan's suspension and guide discs.

These two arms 19 may be designed so that they are self-locking in the Cardan's suspension 23 about a vertical axis at a given deviation from the nominal radial direction in towards the drilling centre. In the other direction, the arms are free and will follow the direction of force in the cables 7. Vertically, the arms 19 are free at all times. The purpose of such an arrangement is that contact between the mooring cable 7 and the riser 13 can efficiently be prevented simply by locking the turret 3 against the vessel 1 at a given angle. From this point the vessel 1 can continue its rotation, as the "self-locked" arm 19 will cause the mooring cable to change direction at the outermost point of the arm 19 (guide disc 25) in the same way as if there were a virtual increase in the diameter of the turret 3.

One consequence of a further rotation is that a torque will be produced (resistance to rotation) on the turret 3 (and the vessel 1) from the moorings. This torque must then be overcome by providing propeller power on the long torque arm, for example, crosswise in the stern of the vessel. The torque is reduced to a large extent simply because only one of the arms 19 is effective, the opposite arm not providing any additional torque apart from the nominal torque (e.g., at 5 meters radius). This torque will also be reduced by the fact that the cables 7 which enter the locked arm 19 will be relieved of tension because it will be "down wind" of the weather. Calculations show that only a moderate propeller torque need be generated in order to force the vessel 1 almost 90°. This will be a typical "wait for the weather condition" and as such will not have such great demands on the position of the vessel 1 on the surface, as long as the riser 13 exceeds certain angles of inclination.

The aforementioned torque which is applied to the locked turret 3 and is transferred thence to the vessel 1 may be a structural and operational disadvantage. A solution of this kind also causes a dimensioning problem for the two arms 19 and their mounts 24 in the turret because the lever may be considerable.

One way in which to avoid this is to remove the said one-way locking function of the arms (in the Cardan joint) and allow the Cardan function to be free. Instead, the said locking can be provided by allowing the arm 19 which enters the critical sector to meet one or more stops 30 which are dropped down under the bottom of the vessel 1. In this connection reference is made to FIG. 10, and also FIG. 7, where the stops are indicated as dots.

The vertical position of these stops 30 can be adjusted and monitored so that they move in a structurally correctly configured engagement with the critical arm 19. After the riser has, if necessary, been broken and shut off, the stops 30 can be drawn into the hull or removed in some other manner so that they do not obstruct the vessel 1 from weathercocking around the whole horizon. In one embodiment, the stops 30 can be made so that the arm 19 will function with a leverage effect on the turret 3 so that the connection/locking mechanism on the turret is almost neutralised as regards the torque of the two other mooring clusters.

What is claimed is:

1. A method for exploiting natural resources under a seabed, the method comprising the steps of:

geostationary anchoring a surface vessel by mooring cables extending from a turret rotatable relative to the vessel about a vertical axis;

drilling a well in the seabed by a drilling section in the vessel at a distance from the axis of rotation of the turret; the drilling section connected to a drill string through a riser extending from the seabed to the drilling section, which riser can be broken and shut off between the seabed and the vessel; and holding the vessel in position by manipulating the mooring cables so that the drilling section is kept geostationary relative to the well during drilling.

2. The method according to claim 1, further comprising placing the mooring cables in three angularly spaced apart clusters.

3. The method according to claim 2, further comprising passing production risers from the seabed up into the turret between the clusters of mooring cables.

4. The method according to claim 1, wherein the mooring cables from the turret are passed radially outwards via rigid arms supported by Cardan joints in the turret.

5. A system for drilling a well in a seabed, comprising:

a surface vessel;

means for holding the vessel in a desired position above a point on the seabed, which means comprise a turret rotatable relative to the vessel about a vertical axis and which can be anchored to the seabed by a plurality of mooring cables; and a riser extending from the seabed to the vessel through which the well can be drilled with a drill string from a derrick in a drilling section on board the vessel;

wherein the turret and the drilling section are arranged so as to be spaced apart in the longitudinal direction of the vessel;

wherein the riser is arranged in a circular sector around the turret which is free of mooring cables and possible production risers;

wherein the turret consists of means for manipulating the mooring cables; and wherein the riser is capable of breaking and being shut off between the seabed and the vessel.

6. The system according to claim 5, wherein the mooring cables are placed in three angularly spaced apart clusters.

7. The system according to claim 6, wherein the turret is designed to receive production risers from the seabed between the clusters of mooring cables.

8. The system according to claim 5, further comprising rigid arms extending from the bottom of the turret, the rigid arms supported in the turret by Cardan joints and which at their outer ends have guide discs for the mooring cables.

9. The system according to claim 8, further comprising a stop arranged in the vessel for the pivotal movement of a respective rigid arm in the turret plane.

10. The system according to claim 9, wherein the stop is maneuverable between an inactive position and a stopping position relative to the associated rigid arm.

* * * * *